US007055284B2

(12) United States Patent
Napoli et al.

(10) Patent No.: US 7,055,284 B2
(45) Date of Patent: Jun. 6, 2006

(54) WINDOW REGULATOR HAVING A DRIVING THREADED SHAFT WHOSE DISTANCE FROM THE WINDOW IS VARIABLE

(76) Inventors: Andrea Napoli, Serra Riccò, 18, I-16164 Genova (IT); Antonio Solari, Largo Marconi, 7, I-16040 Leivi (IT); Roberto Mottola, Via Privata Argiroffo, 1, I-16043 Chiavari (IT)

( * ) Notice: Subject to any disclaimer, the term of this patent is extended or adjusted under 35 U.S.C. 154(b) by 0 days.

(21) Appl. No.: 10/793,222

(22) Filed: Mar. 5, 2004

(65) Prior Publication Data

US 2004/0237409 A1 Dec. 2, 2004

(30) Foreign Application Priority Data

Mar. 7, 2003 (IT) ..... TO2003A0172

(51) Int. Cl.
*E05F 15/16* (2006.01)

(52) U.S. Cl. ..... 49/349; 49/362; 49/374

(58) Field of Classification Search ..... 49/350, 49/349, 348, 362, 374, 375
See application file for complete search history.

(56) References Cited

U.S. PATENT DOCUMENTS

| | | | | |
|---|---|---|---|---|
| 1,627,331 A | | 5/1927 | Hirst | |
| 2,124,037 A | * | 7/1938 | Lavigne | 180/286 |
| 2,311,972 A | * | 2/1943 | Simpson | 74/424.74 |
| 2,337,867 A | * | 12/1943 | Brotman et al. | 49/349 |
| 2,714,004 A | * | 7/1955 | Wise | 49/349 |
| 2,731,261 A | * | 1/1956 | Drum | 49/349 |
| 2,768,532 A | * | 10/1956 | Russell | 74/424.75 |
| 2,913,920 A | * | 11/1959 | Wise | 74/424.92 |
| 2,914,315 A | * | 11/1959 | Wise | 49/349 |
| 2,914,366 A | * | 11/1959 | Anderson | 384/590 |
| 2,922,639 A | * | 1/1960 | Martens | 49/227 |
| 2,945,691 A | * | 7/1960 | Swift et al. | 74/89.36 |
| 2,947,535 A | * | 8/1960 | Crosby | 74/424.92 |
| 2,955,816 A | * | 10/1960 | Wise | 49/349 |
| 2,974,539 A | * | 3/1961 | Martens | 74/424.92 |
| 3,014,715 A | * | 12/1961 | Martens | 49/349 |
| 3,062,528 A | * | 11/1962 | Martens | 49/227 |
| 3,228,677 A | * | 1/1966 | Martens | 49/41 |
| 4,575,967 A | * | 3/1986 | Bickerstaff | 49/211 |
| 4,730,414 A | * | 3/1988 | Nakamura et al. | 49/348 |
| 5,012,613 A | * | 5/1991 | Sekine | 49/362 |
| 5,966,872 A | * | 10/1999 | Wasek et al. | 49/375 |
| 6,427,385 B1 | * | 8/2002 | Fin | 49/340 |

FOREIGN PATENT DOCUMENTS

| | | |
|---|---|---|
| EP | 0 384 685 | 8/1990 |
| FR | 1294605 | 7/1960 |
| FR | 2431594 | 2/1980 |
| GB | 2 026 597 A | 2/1980 |

* cited by examiner

*Primary Examiner*—Gregory J. Strimbu
(74) *Attorney, Agent, or Firm*—Sughrue Mion, PLLC

(57) ABSTRACT

A window regulator includes a threaded shaft (20) arranged at the concave side of the window (16) and extending in the direction of sliding of the same window, a nut screw (24) engaging the threaded shaft (20), which is movable up and down along the shaft, a driving member (26) fastened to a lower zone of the window (16), and a member for interconnecting the nut screw (24) and the driving member (26), adapted to ensure the interconnection of the driving member (26) and the nut screw (24) independently of their distance. The interconnection member includes at least a rigid connecting rod (36; 36*a*) articulated on one side to the nut screw (24) and on the other side to the driving member (26), which is able to assume different tilts when the distance between the driving member (26) and the nut screw (24) changes.

8 Claims, 6 Drawing Sheets

WINDOW REGULATOR HAVING A DRIVING THREADED SHAFT WHOSE DISTANCE FROM THE WINDOW IS VARIABLE

BACKGROUND OF THE INVENTION

The present invention refers to a window regulator for motor vehicles.

Window regulators in which raising and lowering movements of the window are obtained by a threaded shaft and nut screw transmission, are known from the outset of the automotive industry.

When the motor vehicles were equipped by sliding flat windows, the transmissions were easy to made since the threaded shaft and the window were parallel to each other and it was enough to interconnect them by a rigid driving member. One example, between the many, is given in U.S. Pat. No. 1,627,331, published in 1927.

With the coming of bent windows many manufacturers tried to maintain the threaded shaft and nut screw transmissions by striving to make window regulators equipped by interconnection means between the nut screw and the driving member, which were able to ensure the interconnection of the driving member and the nut screw independently of the variable distance between them.

Examples of these interconnection means are given in prior documents FR-A-1 294 605 and FR-A-2 431 594 (and corresponding GB-A-2 026 597).

According to FR-A-1 294 605, the interconnection means comprise a resilient blade constituting a leaf spring the middle portion of which is fixed to the nut screw and the ends of which are provided with small rollers sliding in corresponding horizontal slits of a support and driving bracket of the window.

According to FR-A-2 431 594, the interconnection means comprise two box shaped bodies, one of which, the outer one, is fastened to the nut screw and the other of which, the inner one, is connected to a support and driving bracket of the window and is slidable telescopically in the inner body according to a direction perpendicular to the axis of the threaded shaft. An intermediate bracket provided with small rollers having a cuntersunk groove, in which a rail is engaged which form part of the support and driving bracket of the window, is fastened to the inner box shaped body. The cuntersunk shape of the groove of the small rollers allows a reciprocal oscillation of the two brackets to take place, in order to fit the bending of the window.

The modern trend of the automotive industry is to adopt more and more bent windows, so that the solutions proposed in the two prior documents FR-A-1 294 605 and FR-A-2 431 594, besides being relatively complex, badly lend to be fitted to very bent windows: in the first case, the resilient blade can assume with difficultly a maximum camber corresponding to the zone in which its connection point to the window is more far away from the threaded shaft; in the second case, the telescopic sliding travel of the body fastened to the window and the oscillation amplitude allowed by the small grooved rollers cannot exceed a preset limit.

From EP-A-0 384 685 and corresponding U.S. Pat. No. 5,012,613 a threaded shaft and nut screw window regulator for strongly bent windows is known, in which the threaded shaft is bent and is fixed. A nut screw is contained in a gearcase which is fastened to a support and driving bracket of the window and which is raised and lowered together with the bracket, according to the bent path of the window. The nut screw has the shape of a gearwheel having a helical peripheral toothing which meshes with a worm screw contained in the gearcase. The nut screw is connected to a fixed electric motor through a flexible driving shaft, the axis of which can be deformed in order to fit the variable distance between the motor and the gearcase.

The solution of EP-A-0 384 685 and U.S. Pat. No. 5,012,613 has the drawback to require a bent, relatively expensive, threaded shaft, and the use of a flexible driving shaft with a deformable axis enduring cyclical deformations in operation, which may cause its breaking. Moreover, the weight of its reduction box, which is raised and lowered together with the window, undesirably increases the weight of the movable unit of the window.

SUMMARY OF THE INVENTION

The object of the invention is to supply a threaded shaft and nut screw window regulator having a simple structure which can be manufactured at a low cost, which does not have the drawbacks of the known prior art and which is adapted to be used in the most suitable manner with windows having a considerable bending.

According to the invention, this object is reached by means of a window regulator such as claimed.

By virtue of the idea of solution claimed, a window regulator according to the invention, besides having a very simple and reliable structure, is suitable to be used with windows having a considerable bending thanks to the possibility to give whichever suitable length to the connecting rod or to the connecting rods, which may fit the maximum distance, even if important, that the driving member of the window may assume with respect to the threaded shaft in a given point of the travel of the window.

BRIEF DESCRIPTION OF THE DRAWINGS

The invention will be better understood from the reading of the following detailed description, given as a non limitative example and referred to the appended drawings in which.

DETAILED DESCRIPTION OF THE INVENTION

Figure 1:
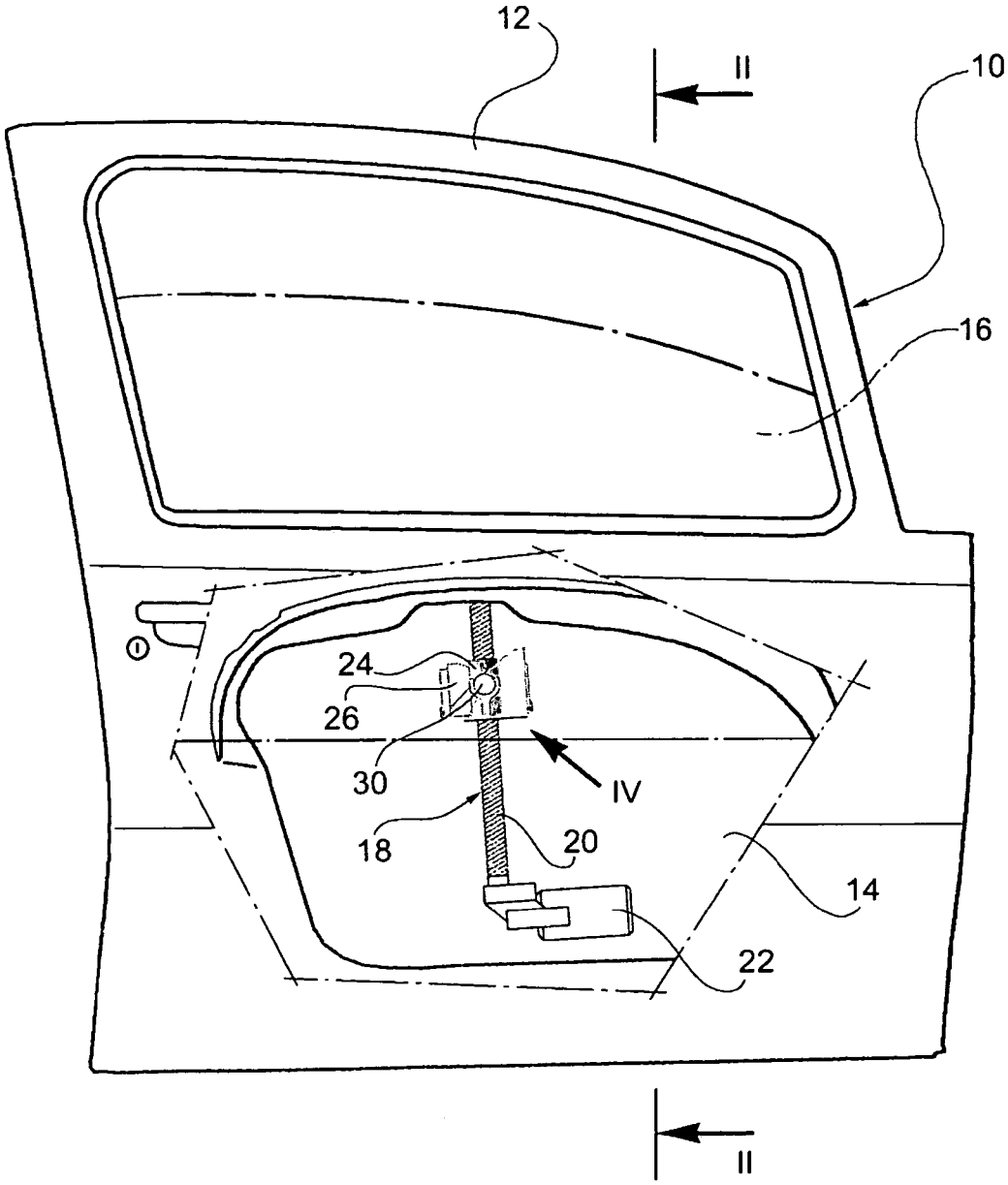
FIG. 1 is an outside broken elevational view of a motor vehicle door provided with a window regulator according to a first modification of the invention.
Figure 2:
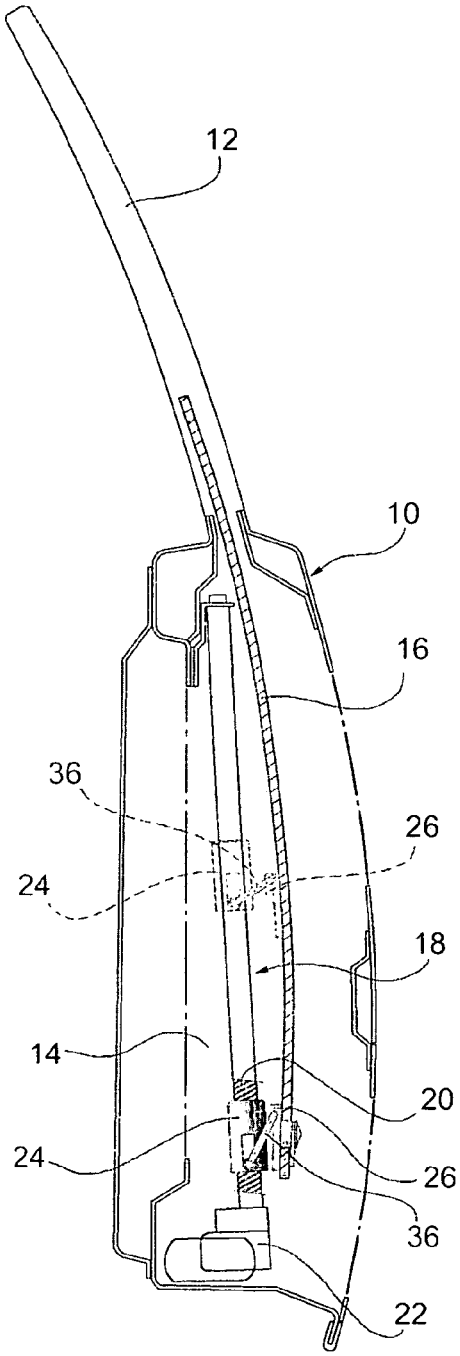
FIG. 2 is a cross-sectional view of the door in the plan indicated II—II in FIG. 1, in which the window is fully lowered.
Figure 3:
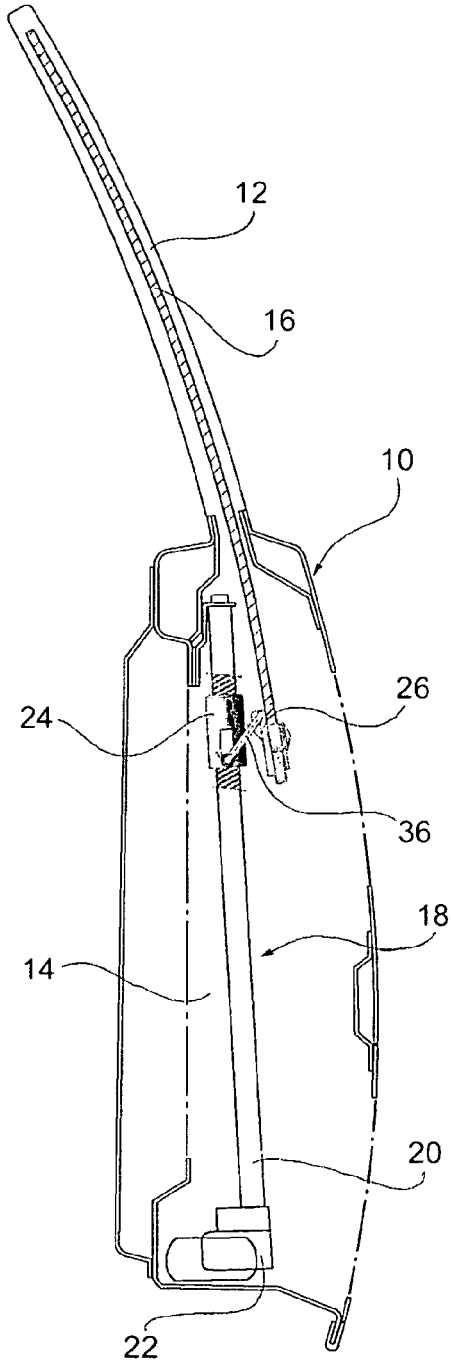
FIG. 3 is a sectional view analogous to FIG. 2, in which the window is fully raised.
Figure 4:
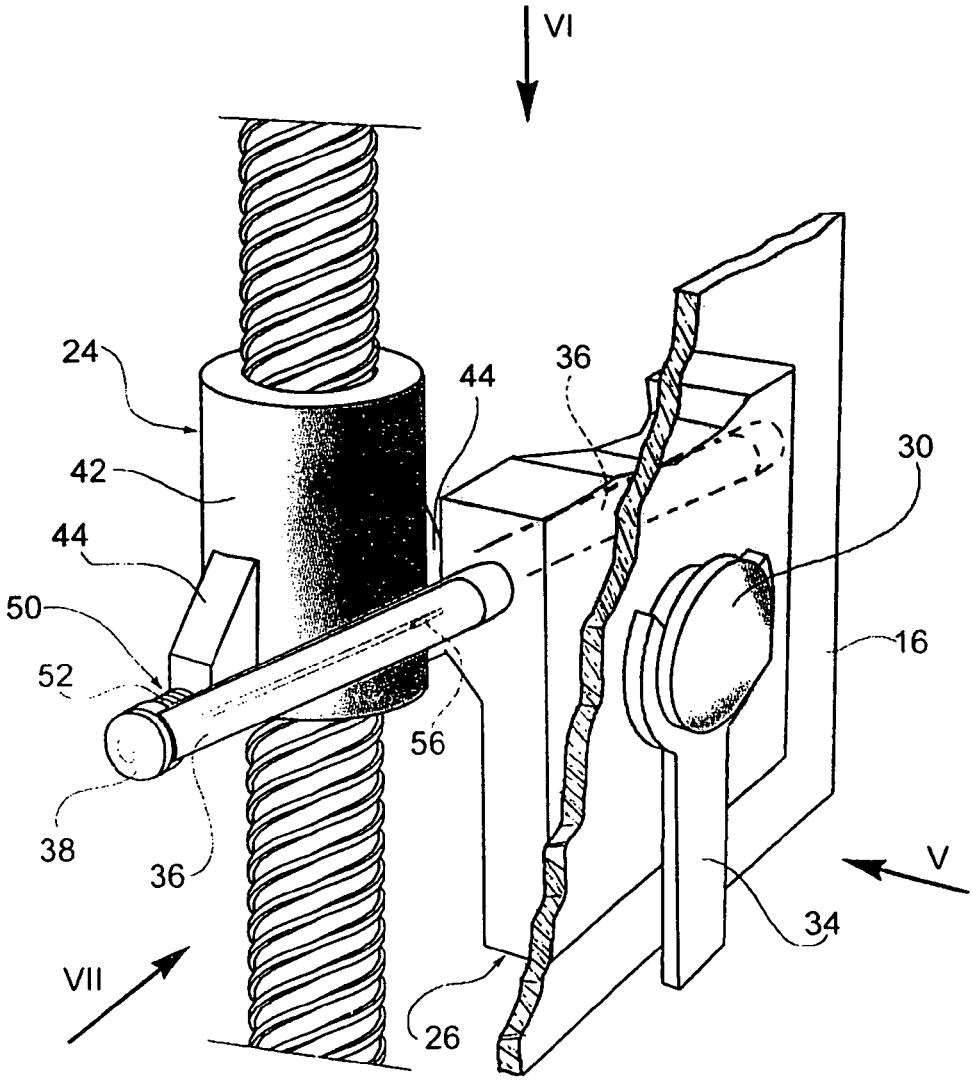
FIG. 4 is a detail perspective view in a larger scale, of the unit indicated IV in FIGS. 1 to 3.
Figure 5:
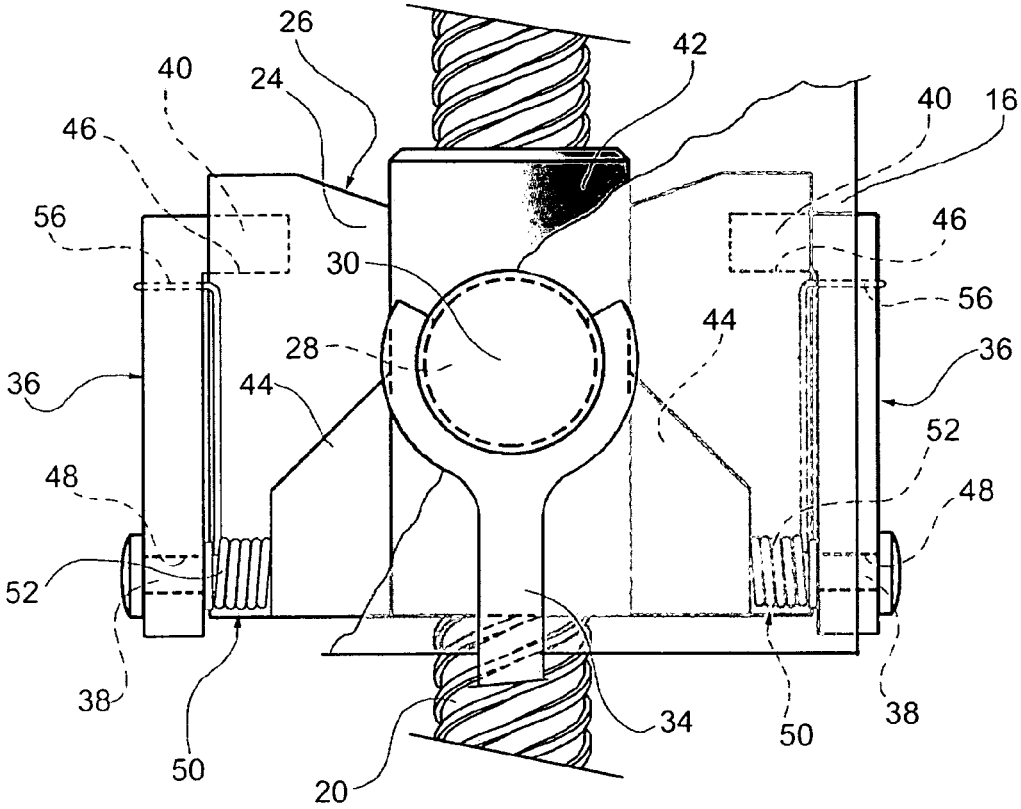
FIG. 5 is a frontal view of the same unit, according to arrow V of FIG. 4.
Figure 6:
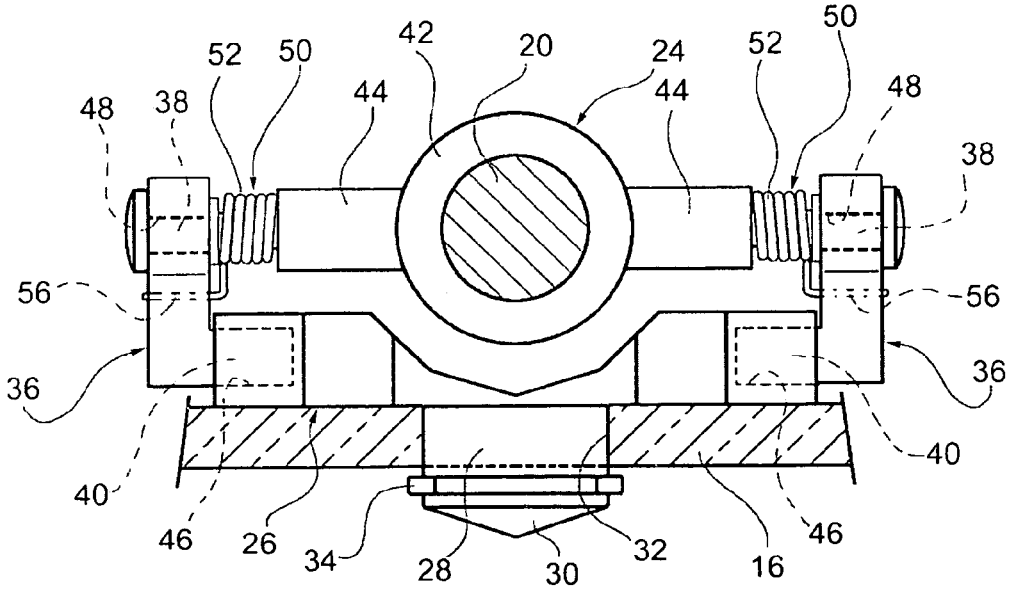
FIG. 6 is an elevational view thereof, according to arrow VI of FIG. 4, FIGS. 7 and 8 are side views of the same unit in two different configurations, both according to arrow VII of FIG. 4.

With initial reference to FIGS. 1 to 8 which represent a first modification of the invention, in FIGS. 1 to 3 a door of a motor vehicle (or of another part of a motor vehicle body) is illustrated, which comprises a framework, indicated 10 as a whole, with an upper portion having an opening and which forms a window frame 12, and having a lower space 14.

In the framework 10 a bent window 16 is mounted, which is slidable between a lowered position (FIG. 2), in which it is at least partially lowered in the space 14, and a raised position (FIG. 3), in which it is inserted in the frame 12.

A window regulator according to a first modification of the invention, indicated 18 as a whole, is installed in the space 14 in order to raise and lower the window 16.

The window regulator 18 comprises a threaded shaft 20, rotatably supported in the space 14 by keeping means and which, in the installed condition of FIGS. 1 to 3, is arranged at the concave side of the window 16 and extends in the substantially vertical sliding direction of the window itself.

Control means are provided for driving into bidirectional rotation the threaded shaft, which are constituted, in a preferred embodiment, by an electrical reduction gear 22 arranged at the lower end of the threaded shaft 20.

In the following description, particular reference will be made to FIGS. 3 to 8.

The window regulator 18 comprises a nut screw 24 which engages the threaded shaft 20 and is movable to-and-fro along the shaft 20 because of its rotation.

A driving member 26 is fastened to a lower zone of the window 16, which, as better illustrated in FIGS. 4 to 8, has the shape of a relatively thick plate.

Preferably, the driving member 26 has a cylindrical hub 28 which is inserted and held by a head 30 in a corresponding hole 32 of the lower zone of the window 16.

A clip indicated 34 is used for the precise positioning of the window 16, when it is assembled on the hub 28.

Means adapted to ensure the interconnection of the nut screw 24 and the driving member 26 independently of their distance, are provided between them.

According to the invention, these interconnection means comprise at least one rigid connecting rod 36 articulated by means of pins 38, 40 on one side to the nut screw 24 and on the other side to the driving member 26, according to an arrangement such as to allow a variable configuration to be assumed in order to change the distance between the driving member 26 and the nut screw 24.

Preferably, as illustrated in FIGS. 3 to 6, two rigid twin parallel connecting rods 36 are provided, which are arranged at respective opposite sides of the nut screw 24 and the driving member 26.

Also preferably, the nut screw 24 comprise a bush shaped body 42 with two diametrically opposite side appendages 44 carrying the pins 38.

Also, preferably, the driving member 26 has two opposite pivoting seats 46. Each of the two twin connecting rods 36 has on one side a hole 48 for pivoting it about the pin 38 of the respective side appendage 44 of the nut screw 24, and on the other side one of the aforesaid pins 40, which is inserted in a respective pivoting seat 46 of the driving member 26.

Elastic return means are advantageously associated to each connecting rod 36, which tend to angularly return it toward the nut screw 24. According to a preferred embodiment, these elastic return means consist, for each connecting rod 36, of a return spring 50 having a helical intermediate portion 52 surrounding the pin 38 for the articulation of the connecting rod 36 to the nut screw 24, and two end portions one of which, 54, is engaged with the nut screw and the other of which, 56, is engaged with the connecting rod 36.

The presence of the springs 50, or of any equivalent elastic return means, is advantageous for the reason that will be clarified below.

When the window 16 is fully lowered, such as in FIG. 2, the driving member 26 is substantially close to the nut screw 24. The connecting rods 36 are directed upwardly substantially in the configuration of FIG. 7, and form a relatively small angle $\alpha_1$ with the axis of threaded shaft 20.

As the window 16 is raised, the connecting rods 36 pull apart with respect to the shaft 20.

Figure 8:
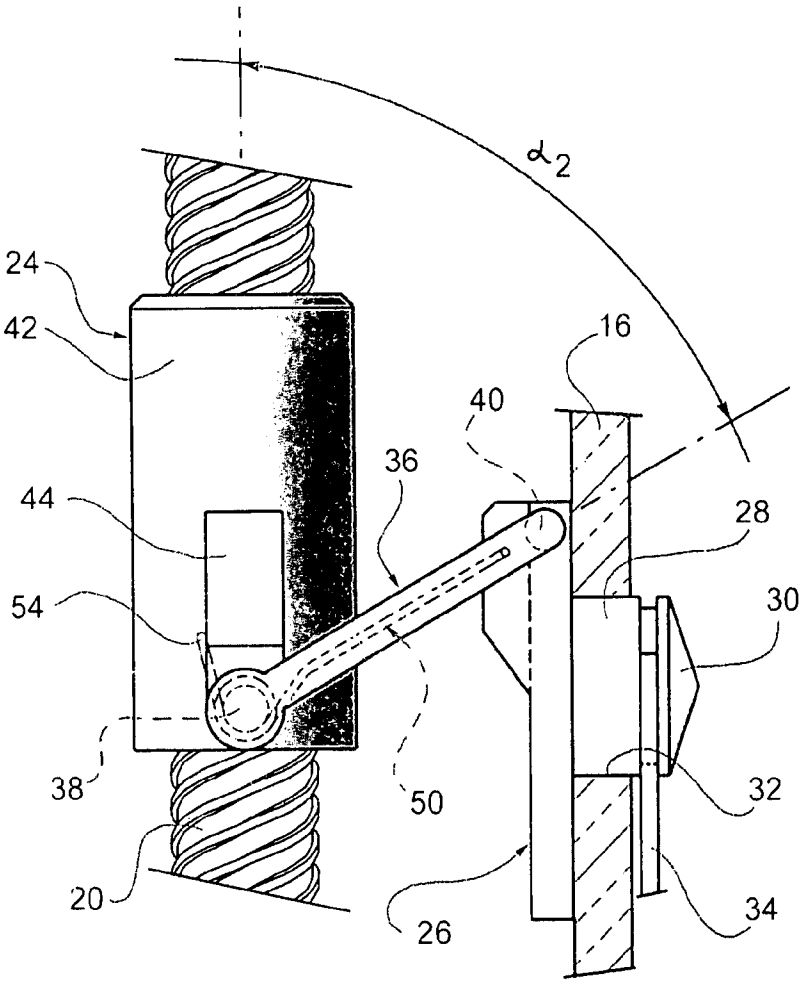
Figure 7:
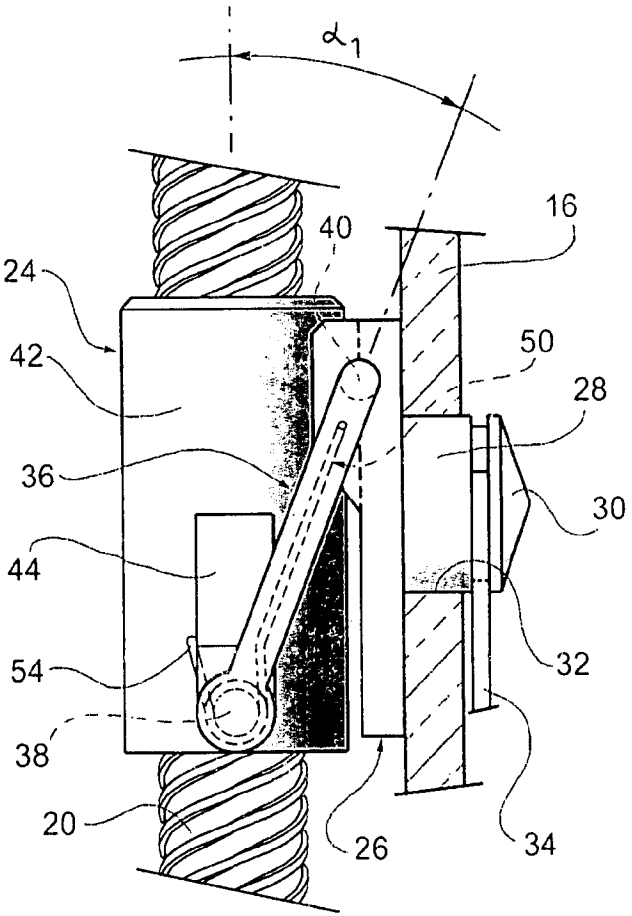

In the zone in which the window 16 is more distant from the shaft 20, as illustrated in dashed lines in FIG. 2, the connecting rods 36 reach a configuration, such as in FIG. 8, in which their angle $\alpha_2$ is very open with respect to the axis of the shaft 20, as an example of 75°.

During the raising movement of the connecting rods 36, a component of force is generated, which tends it itself to pull apart them and to favour their jamming.

In the configuration of FIG. 8, with a very wide angle $\alpha_2$, in the absence of return springs 50, the jamming of the connecting rods 36 could actually take place, making impossible the further raising of the window 16. The return springs 50 have exactly the function to prevent the jamming and to guarantee the raising of the window 16 until the position of complete closing, illustrated in FIG. 8, is reached.

Advantageously, the threads of the threaded shaft 20 and the nut screw 24 have a wide pitch in order to allow relatively fast raising and lowering travels of the window 16, with relatively slow speeds of rotation of the shaft 20.

Since a wide pitch of the threads is necessarily reversible, locking means are associated to the threaded shaft 24 in order to prevent its rotation when the control means thereof are not driven.

If the control means consist of a crank or of an electric motor for driving the shaft 20 through a gearing different from a worm screw reduction gear, a self-locking device of the "autolock" type can be associated to the shaft.

If instead, as it is preferred, the control means consist of an electrical worm screw reduction gear, such as that one indicated 22 in FIGS. 1 to 3, this reduction gear, when it is not powered, likewise constitutes the locking means of the rotation of threaded shaft 20.

Figure 9:
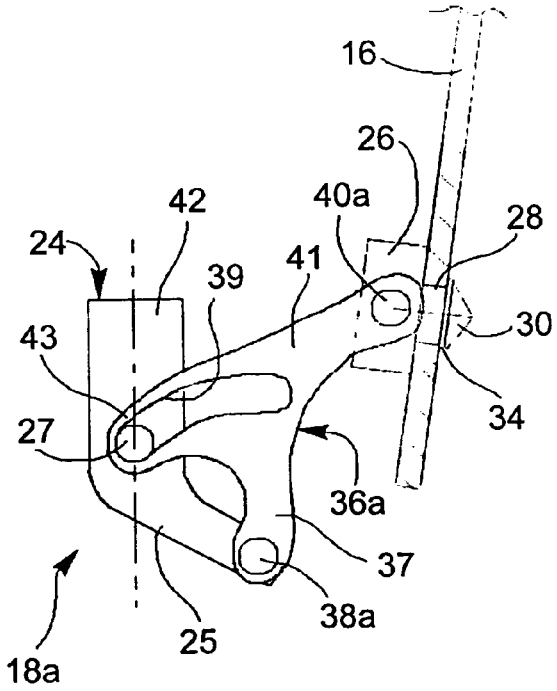
FIG. 9 is a schematic side elevational view of a connecting rod-nut screw unit according to another modification of the invention.
Figure 10:
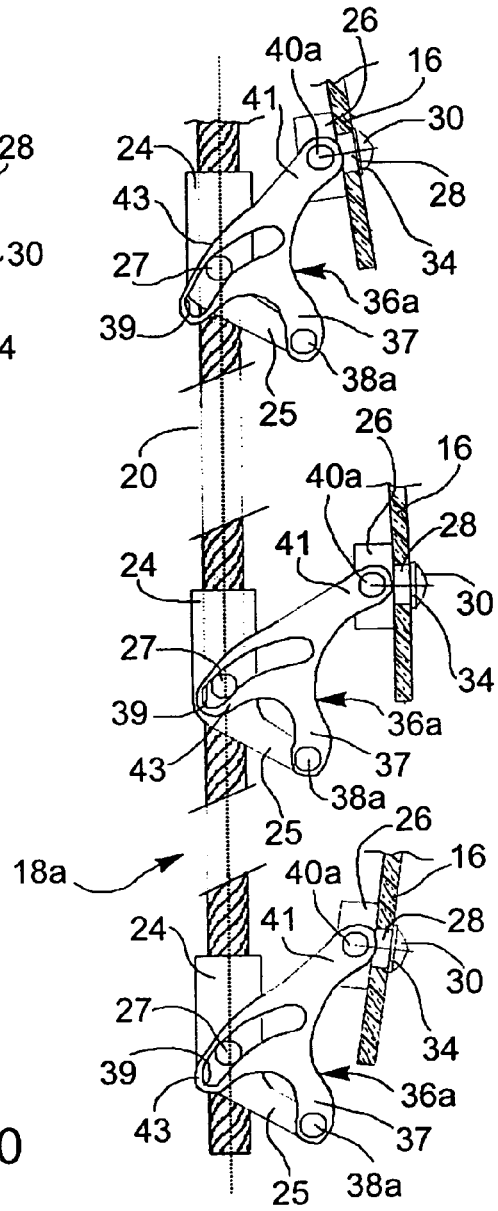
FIG. 10 is a side elevational view in a reduced scale schematically illustrating the unit of FIG. 9 in three different positions with respect to the threaded shaft, respectively corresponding to three different raising conditions of the window.

Another modification of the invention, in which the window regulator is indicated **18*a* as a whole, is illustrated in FIGS. 9 and 10 in which the same numeral references have been used in order to indicate parts equal or similar to those of the previous figures. According to this modification, an auxiliary appendage 25 extends from the lower portion of the nut screw 24 towards the window 16, for example slant downwardly with respect to its bush shaped body 42, from which a pair of pins 38*a* preferably project transversely to the shaft 20. The first ends 37 of a pair of rigid connecting rods (only one of which can be seen in FIGS. 9 and 10), indicated by the reference 36*a* in this modification, are articulated about the pins 38*a*. The second end 41 of each connecting rod 36*a*, opposite to the first end 37, is pivotably mounted about one pin of a pair of pins 40*a* extending from the driving member 26 in a direction parallel to the pins 38*a***.

Preferably, each connecting rod **36*a* has a protruding arm 43 in which an elongated slit 39 is formed, having an arched shape concentric with the respective pin 38*a*, in which slit is slidably engaged a pin of a pair of reference pins 27 which extend from diametrically opposite portions of the bush shaped body 42 of the nut screw 24, in a direction parallel to the pins 38***a*. The head of the pins 27 may have an enlarged shape, that is a diameter larger than the portion of such pins which engages the respective slit 39, in order to limit the side movement of the connecting rods 36*a*. Obviously, also in this case, a single connecting rod 36*a* could be used in the window regulator of the invention, even if the configuration with two twin connecting rods 36*a* is preferred.

Although in FIGS. 9 and 10 have not been illustrated elastic means for the angular return of the connecting rod or the connecting rods 36*a* towards the nut screw 24, these means could be used and assume in such a case a shape analogous to that one of the return springs 50 of the previous modification. However, the structure of the connecting rod or the connecting rods 36*a* of the present modification makes the window regulator less subject to jamming risks, whereby such elastic means can be advantageously avoided.

A window regulator according to the invention allows the manufacturing at a low cost of three of its main elements, that is of the nut screw 24, the driving-member 26 and the connecting rods 36 or 36*a*, by plastic materials such as superpolyamides and/or politetrafluoroethylene.

What is claimed is:

1. A window regulator, including:

a bent window having a concave side, a threaded shaft rotatably supported by supporting means associated with a motor vehicle door in a lower zone of a space defined by said door in which the bent window is slidable, said threaded shaft being arranged, in the installed condition, on the concave side of the window and extending along a director generally parallel to a general sliding direction of the window, control means for controlling bidirectional rotation of the threaded shaft, a nut screw engaging the threaded shaft, and movable up and down along the shaft as a consequence of the rotation of the shaft, a driving member adapted to be fastened to a lower zone of the window, and means for interconnecting the nut screw and the driving member, said interconnecting means comprising at least one rigid connecting rod having a first end articulated to the nut screw by a first pin and a second end articulated to the driving member by a second pin, so that the connecting rod is able to assume a variable tilt with respect to the threaded shaft as a result of a change in the distance between the driving member and the nut screw, wherein the nut screw comprises an auxiliary appendage extending towards the window, from which said first pin extends for supporting the articulation of said first end of said connecting rod thereon, said second pin being parallel to said first pin, said connecting rod having an arched slit having a radius which is concentric with said first pin and in which a reference pin, parallel to said first pin, is slidably engaged.

2. A window regulator according to claim 1, wherein said connecting rod comprises two parallel rigid connecting rods which are arranged at respective opposite sides of the nut screw and of the driving member.

3. A window regulator according to claim 1, wherein said slit of said connecting rod extends along an arm protruding from the connecting rod.

4. A window regulator according to claim 1, wherein said connecting rod includes means for urging said connecting rod towards the nut screw.

5. A window regulator according to claim 4, wherein the urging means comprises a return spring having a helical intermediate portion surrounding said first pin, and having two end portions one of which is engaged with the nut screw and the other of which is engaged with the connecting rod.

6. A window regulator according to claim 1, wherein the driving member has a cylindrical hub adapted to be inserted and withheld in a corresponding hole of the lower zone of the window.

7. A window regulator according to claim 1, wherein the pitch of the threads of the threaded shaft and of the nut screw is such that it allows a reversible motion of the nut screw relative to the threaded shaft, and wherein locking means are associated with the threaded shaft in order to prevent rotation of the threaded shaft when the control means are not driven.

8. A window regulator according to claim 7, wherein the locking means comprises a worm screw reduction gear.

* * * * *